United States Patent [19]

Butler et al.

[11] 4,164,654

[45] Aug. 14, 1979

[54] DEVICE FOR GENERATING AN ATOMIC CLOUD

[75] Inventors: Louis R. P. Butler; Hendrik G. C. Human, both of Pretoria, South Africa

[73] Assignee: The South African Inventions Development Corporation, Pretoria, South Africa

[21] Appl. No.: 877,657

[22] Filed: Feb. 14, 1978

[51] Int. Cl.[2] ..... H01J 27/00

[52] U.S. Cl. ..... 250/426; 250/373; 250/423 R

[58] Field of Search ..... 250/423 R, 426, 427, 250/373

[56] References Cited

U.S. PATENT DOCUMENTS

| | | | |
|---|---|---|---|
| 2,636,990 | 4/1953 | Gow | 250/426 |
| 2,785,311 | 3/1957 | Lawrence | 250/426 |
| 2,806,161 | 9/1957 | Foster | 250/426 |
| 3,265,890 | 8/1966 | Briggs | 250/427 |
| 3,409,529 | 11/1968 | Chopra et al. | 250/426 |
| 3,457,407 | 7/1969 | Goldberg | 250/373 |
| 3,849,656 | 11/1974 | Wallington | 250/427 |

*Primary Examiner*—Harold A. Dixon

*Attorney, Agent, or Firm*—Leydig, Voit, Osann, Mayer & Holt, Ltd.

[57] ABSTRACT

This invention relates to a device for generating an atomic cloud, the device having a housing in which is housed a cathode and an anode, and with suitable passages or flow directing members to direct flow of a gas outwardly away from or past the cathode discharge surface, so that when a suitable potential is applied across the anode and the cathode a glow discharge occurs between the anode and the cathode. The flow of gas preferably draws atoms that are ejected from the cathode discharge surface away from the cathode to a region beyond the cathode glow region, thereby to generate an atomic cloud having a low value of inherent radiation. The device is further incorporated with an apparatus for spectro-scopically analyzing a substance by fluorescent techniques.

32 Claims, 3 Drawing Figures

DEVICE FOR GENERATING AN ATOMIC CLOUD

BACKGROUND TO THE INVENTION

This invention relates to a device for generating an atomic cloud, to a method of generating the atomic cloud, to an apparatus for spectro-scopically analysing a substance which includes the device, and to a method of spectro-scopically analysing a substance which includes the method according to the invention of generating an atomic cloud.

In order to qualitatively or quantitatively analyse substances by spectroscopic techniques, either by detecting emission or absorption of characteristic radiation, it is necessary to generate an atomic cloud. Further, with emissive techniques utilising fluorescence of the atomic cloud, it is desirable that the atomic cloud has a low value of inherent radiation.

It is an object of the present invention to provide a device which generates a suitably dense atomic cloud which preferably has a low value of inherent radiation.

Accordingly, the invention provides a device for generating an atomic cloud which includes

- a housing having an inlet and an outlet port through which a gas may be introduced into and removed from the housing;
- a cathode having a discharge surface located within the housing;
- an anode also located within the housing, spaced from and electrically insulated from the cathode and located such that a discharge may occur between the discharge surface of the cathode and the anode; and
- a gas flow directing means for directing a flow of the gas from the inlet port outwardly away from or past the cathode discharge surface, such that, in use, when a suitable potential is applied across the anode and the cathode a glow discharge occurs between the anode and the cathode discharge surface.

Further according to the invention, there is provided a method of generating an atomic cloud, which includes

- providing a device for generating an atomic cloud which has an anode and a cathode having a discharge surface located within a gas-tight housing;
- applying a suitable potential across the anode and the cathode; and
- causing a gas to flow outwardly away from or past the surface, such that a glow discharge occurs between the anode and the cathode.

The gas flow directing means may be such that in use, atoms ejected from the cathode discharge surface are drawn by the gas flow away from the cathode discharge surface to a region beyond the cathode glow region. Thus, the gas may be caused to flow past the periphery of the cathode discharge surface, and/or the cathode may be provided with a passage which has its outlet opening in the cathode discharge surface, such that the gas flows through the passage and out through its outlet opening.

In order to cause the gas to flow past the periphery of the cathode discharge surface, the device may include a gas flow constraining element which is hollow, the cathode being located therein. Preferably, this constraining element is of an electrically insulating material.

The flow rate of the gas may be at a suitable value to ensure a suitable pressure within the housing. Further, the device may be operated at a constant potential difference between the anode and the cathode, or the discharge current between the anode and the cathode may be maintained at a constant value.

The cathode discharge surface may be planar or it may be dished to provide a pseudo-hollow cathode.

In use, a normal or an abnormal glow discharge may occur between the anode and the cathode discharge surface.

The housing may have at least two windows. These windows may be located on optical axes that are mutually orthogonally disposed and which intersect in the region beyond the cathode glow region to which the atoms are drawn by the gas flow. Radiation may enter the device through one of these windows, with resulting fluorescent radiation leaving the device via the other window. In order to minimize the amount of background radiation leaving the housing via the said other window, a region having a low reflectivity may be disposed on the optical axis of the entrance window on the opposite side of the region to which the atoms are drawn to the said window.

The device may have more than one cathode, the cathodes having different chemical compositions. Further in regard to the cathodes, the entire cathodes or at least a portion thereof may be easily replaceably removable.

The anode may have any suitable shape and configuration. It may for example be a rod, pin, plate, or the like.

The anode may be to one side of the cathode discharge surface. Thus, it may be laterally displaced from the line connecting the cathode discharge surface to the region to which the atoms are drawn by the gas flow.

In a particular embodiment, the cathode may be cylindrical, the gas flow being directed along the cylindrical wall thereof past an end wall thereof which constitutes the cathode discharge surface.

The gas may be an inert gas, such as argon.

The invention extends further to an apparatus for spectroscopically analysing a substance, which includes a device for generating an atomic cloud in accordance with the invention.

Still further according to the invention there is provided a method of spectroscopically analysing a substance, which includes

- generating an atomic cloud of an element, the concentration whereof in the substance is to be determined, in accordance with the method of the invention;
- irradiating the atomic cloud with radiation emitted by the substance; and
- detecting the amount of fluorescent radiation emitted by the atomic cloud.

DESCRIPTION OF A PREFERRED EMBODIMENT

A preferred embodiment of the invention is now described, by way of an example, with reference to the accompanying drawings, in which.

Figures 1, 3:
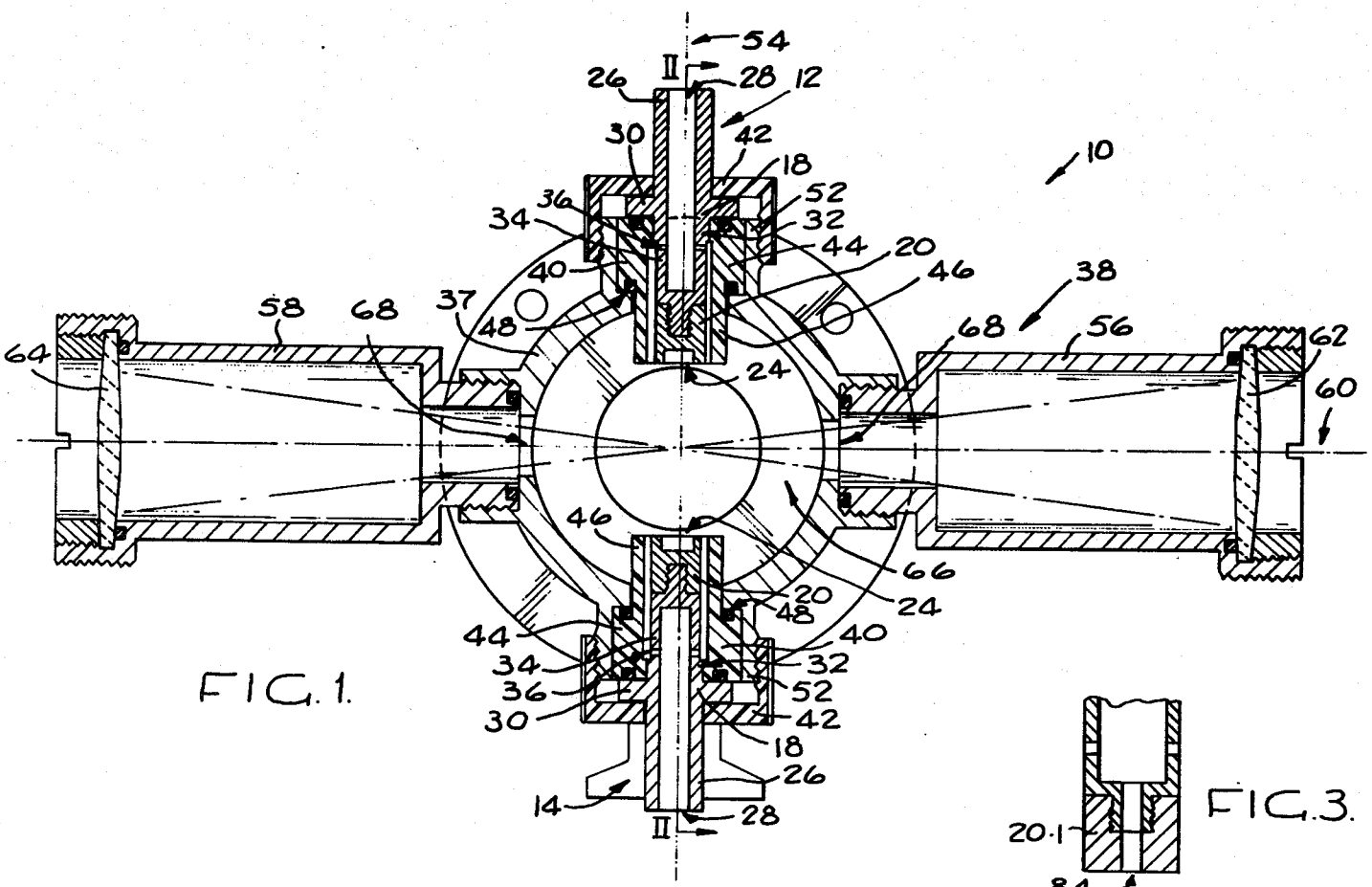
FIG. 1 shows a sectioned view of a device in accordance with the invention for generating an atomic cloud of two elements.
FIG. 3 shows a sectional view of an alternative construction for the cathodes of the device of FIGS. 1 and 2.
Figure 2:
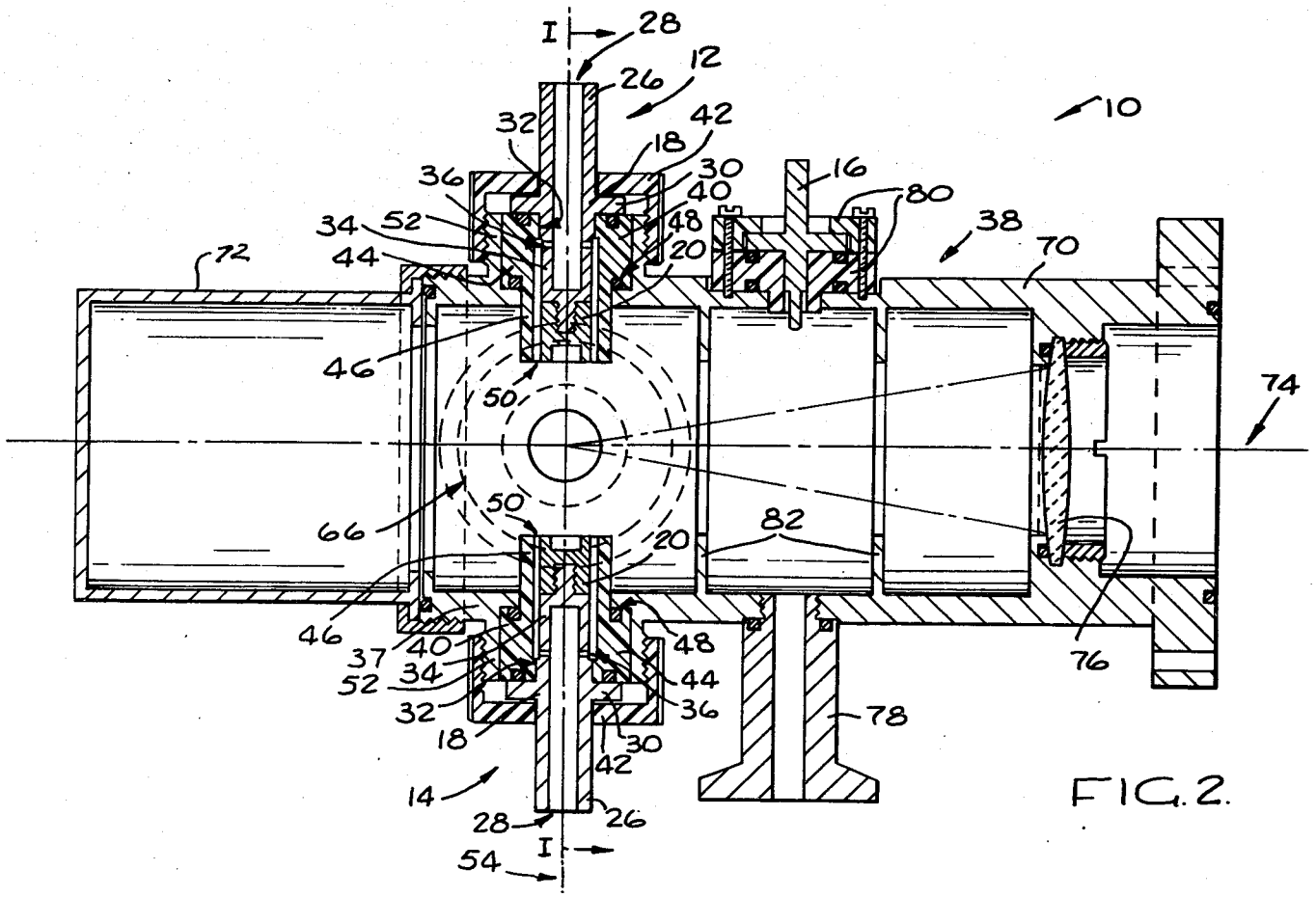
FIG. 2 shows a sectioned view of the device of FIG. 1, along line II—II.

Referring to FIGS. 1 and 2, a device for generating an atomic cloud of two different elements is indicated generally by reference numeral 10. The device 10 has two cathodes 12 and 14 and an anode 16. Each cathode 12, 14 has a body portion 18 and an active tip portion 20. Each tip portion 20 is circular cylindrical and is screw-threadedly secured to the inner end of the body portion 18. The free ends 24 of the tip portions 20 are dished. Further, the tip portions 20 are each of one of the elements required.

The body portions 18 have cylindrical outer portions 26 which have internal axial bores 28. The cylindrical outer portions 26 widen out into securing flanges 30. Adjacent the flanges 30 the body portions 18 have circular cylindrical surfaces 32, which are thicker than the inner end regions 34 of the body portions 18. These end regions 34 have the same thickness as the tip portions 20. Transverse bores 36 are provided in the inner end regions 34, which communicate with the axial bores 28.

The cathodes 12 and 14 are replaceable secured in sockets in a central portion 37 of a housing 38, by collars 40 and caps 42 which are both of an electrically insulating material. The collars 40 have thick outer body portions 44 and thinner neck portions 46, with a stepped shoulder 48. The collars 40 have circular cylindrical inner surfaces which have inner diameters equal to the outer diameters of the surfaces 32. Thereby annular gaps 50 are provided between the collars 40 and the inner end regions 34 and tip portions 20. The sockets are stepped to provide shoulders against which the shoulders 50 abut, the outer ends of the collars 40 engaging the inner surfaces of the flanges 30. The sockets also have externally screw-threaded neck formations 52 which are engaged by the caps 42 which have corresponding internal screw-threads. The caps 42 have suitable apertures through which the outer portions 26 of the cathodes 12 and 14 extend.

As is seen in FIGS. 1 and 2, the cathodes 12 and 14 have a common axis 54 and are disposed on opposite sides of the central portion 37 of the housing 38, with their dished free ends 24 facing each other.

Referring now to FIG. 1, it can be seen that the housing 38 has two tubular side arms 56 and 58 projecting from the central portion 37 in opposite directions. The side arms 56 and 58 have a common axis 60 which is perpendicular to the cathode axis 54. The free ends of the side arms 56 and 58 are closed off by means of lenses 62 and 64. In order to restrict the amount of unwanted radiation which may pass between the chamber 66 defined by the central portion 37 and the tubular side arms 56 and 58, narrow apertures 68 are provided therebetween.

Referring further to FIG. 2, it can be seen that the housing 38 has two further tubular side arms 70 and 72 extending from the central portion 37. These side arms 70 and 72 also have a common axis 74 which is perpendicular with respect to both of the axes 54 and 60. Thus, the axes 54, 60 and 74 are mutually orthogonally disposed. The side arm 70 is open at its free end, this opening being closed by means of a lens 76. Close to the central portion 37, the side arm 70 has an outlet port 78. Opposite the outlet port 78 is located the anode 16 which is secured to the side arm 70 in an aperture therein by means of insulating members 80. Baffles 82 are provided to restrict the amount of unwanted radiation passing between the chamber 66 and the side arm 70. The side arm 72 is located on the other side of the central portion 37 to the side arm 70 and is closed off at its outer end. The inner surface of the side arm 72 has a low reflectivity. This is effected by providing the inner surface of the side arm 72 with a coating of a suitable material, or by suitably treating it. Finally, the axes 54, 60 and 74 intersect in the centre of the chamber 66.

In operation, the housing 38 is evacuated, and a suitable gas such as argon is pumped into the housing 38 through the axial bores 28 in the cylindrical outer portions 26 of the cathodes 12 and 14, through the transverse bores 36, through the annular gaps 50 into the chamber 36; the gas then passing into the side arm 70 to be exhausted through the outlet port 78. A suitable potential difference is applied between the cathodes 12 and 14 and the anode 16, from a suitable supply (not shown) via suitable connections (also not shown). An abnormal or a normal glow discharge occurs between the anode 16 and the dished ends 24 of the cathode tip portions 20. As a result, atoms are ejected from the tip portions 20. These ejected atoms are then drawn away from the tip portions 20 towards the centre of the chamber 66. The potential between the anode 16 and the cathodes 12 and 14, or the discharge current between them is controlled such that the cathode glow regions lie between the free ends 24 and the centre of the chamber 66. Thereby, an atomic cloud of the two elements under consideration is formed at the centre of the chamber 66, which has a low inherent radiation characteristic.

In order to determine the concentration of the two elements under the consideration in a sample of unknown substance, the sample is caused to emit characteristic radiation which is introduced into the chamber 66 via the side arm 70, the lens 76 focussing the radiation on the atomic cloud located at the centre of the chamber 66. This causes the atoms located there to fluoresce, this fluorescent radiation leaving the device via the side arms 56 and 58, the lenses 62 and 64 focussing this radiation onto suitable detectors.

Referring to FIG. 3, a further tip portion 20.1 is shown. This tip portion 20.1 may be used in the device 10 shown in FIGS. 1 and 2, instead of the tip portions 20. This tip portion 20.1 has an axial bore 84 which communicates with the axial bore 28 in the body portion 18, and which opens in the dished end surface of the tip portion 20.1. Thus, in operation, the gas is also pumped through this axial bore 84 and away from the end surface 52.

I claim:

1. A device for generating an atomic cloud comprising, a housing having an inlet and an outlet port through which a gas may be introduced into and removed from the housing;

a cathode having a discharge surface located within the housing;

an anode also located within the housing, spaced from and electrically insulated from the cathode and located such that a discharge may occur between the discharge surface of the cathode and the anode;

means for connecting a suitable potential across the anode and cathode for causing a glow discharge between the anode and cathode discharge surface thereby to eject atoms from the cathode discharge surface; and gas flow directing means for directing a flow of the gas from the inlet port outwardly away from or past the cathode discharge surface, said gas flow directing means comprising means for causing the ejected atoms to move away from the cathode discharge surface to a region beyond the cathode glow region.

2. A device as claimed in claim 1, in which the gas flow directing means is such that the gas is caused to flow past the periphery of the cathode discharge surface.

3. A device as claimed in claim 2, in which the gas flow directing means comprises a hollow gas flow constraining element, the cathode being located within the constraining element.

4. A device as claimed in claim 3, in which the gas flow constraining element is of an electrically insulating material.

5. A device as claimed in claim 1, in which the cathode has a passage which has its outlet opening in the cathode discharge surface and the gas flow directing means causes the gas to flow through the passage and out through its outlet opening.

6. A device as claimed in claim 1, in which the cathode discharge surface is planar.

7. A device as claimed in claim 1, in which the cathode discharge surface is dished.

8. A device as claimed in claim 1, in which, in use, a normal glow discharge occurs between the anode and the cathode discharge surface.

9. A device as claimed in claim 1, in which, in use, an abnormal glow discharge occurs between the anode and the cathode discharge surface.

10. A device as claimed in claim 1, in which the housing has at least two windows.

11. A device as claimed in claim 10, in which the windows are located on optical axes that are mutually orthogonally disposed and which intersect in the operative region.

12. A device as claimed in claim 11, which includes a region having a low reflectivity disposed on the optical axis of one of the windows on the opposite side of the said operative region to the said window.

13. A device as claimed in claim 1, in which there is more than one cathode.

14. A device as claimed in claim 13, in which the cathodes have different chemical compositions.

15. A device as claimed in claim 1, in which at least a portion of the cathode is easily replaceably removable.

16. A device as claimed in claim 1, in which the housing is electrically insulated from the anode and the cathode.

17. A device as claimed in claim 1, in which the anode is a pin.

18. A device as claimed in claim 1, in which the anode is to one side of the cathode discharge surface.

19. A device as claimed in claim 1, in which the cathode is cylindrical, the gas flow directing means being adapted to direct the flow of the gas along the cylindrical wall(s) of the cathode past an end wall thereof which constitutes the cathode discharge surface.

20. A device as claimed in claim 1, in which the gas is an inert gas.

21. A device as claimed in claim 1, in which the cathode has an internal passage through which the gas is introduced into the housing, the cathode or cathodes thereby constituting the inlet port.

22. An apparatus for spectroscopically analysing a substance, which includes a device for generating an atomic cloud comprising a housing having an inlet and an outlet port through which a gas may be introduced into and removed from the housing;

a cathode having a discharge surface located within the housing;

an anode also located within the housing, spaced from and electrically insulated from the cathode and located such that a discharge may occur between the discharge surface of the cathode and the anode;

means for connecting a suitable potential across the anode and cathode for causing a glow discharge between the anode and cathode discharge surface thereby to eject atoms from the cathode discharge surface; and gas flow directing means for directing a flow of the gas from the inlet port outwardly away from or past the cathode discharge surface, said gas flow directing means comprising means for causing the ejected atoms to move away from the cathode discharge surface to a region beyond the cathode glow region.

23. A method of spectroscopically analysing a substance, comprising the steps of providing a device for generating an atomic cloud which has an anode and a cathode having a discharge surface, said anode and cathode being located within a gas-tight housing;

applying a potential across the anode and the cathode sufficient to cause a glow discharge between the anode and the cathode discharge surface thereby to eject atoms from the cathode discharge surface; and directing a gas flow outwardly away from or past the discharge surface to cause the ejected atoms to move away from the cathode discharge surface to a region beyond the cathode glow region;

irradiating the atomic cloud with radiation emitted by the substance; and detecting the amount of fluorescent radiation emitted by the atomic cloud.

24. A method of generating an atomic cloud, comprising the steps of providing a device for generating an atomic cloud which has an anode and a cathode having a discharge surface, said anode and cathode being located within a gas-tight housing;

applying a potential across the anode and the cathode sufficient to cause a glow discharge between the anode and the cathode discharge surface thereby to eject atoms from the cathode discharge surface; and directing a gas flow outwardly away from or past the discharge surface to cause the ejected atoms to move away from the cathode discharge surface to a region beyond the cathode glow region.

25. A method as claimed in claim 24, in which the discharge is a normal glow discharge.

26. A method as claimed in claim 24, in which the discharge is an abnormal glow discharge.

27. A method as claimed in claim 24, in which the gas is caused to flow past the periphery of the cathode discharge surface.

28. A method as claimed in claim 24, in which the cathode has a passage which has its outlet opening in the cathode discharge surface and the gas is caused to flow through the passage and out through the outlet opening.

29. A method as claimed in claim 24, in which the gas is an inert gas.

30. A method as claimed in claim 24, in which the flow of gas is at a suitable rate to ensure a suitable pressure in the space between the anode and the cathode discharge surface.

31. A method as claimed in claim 24, in which the potential difference between the anode and the cathode is maintained constant.

32. A method as claimed in claim 24, in which the discharge current between the anode and the cathode is maintained constant.

* * * * *